US007956564B2

(12) United States Patent
Morino

(10) Patent No.: US 7,956,564 B2
(45) Date of Patent: Jun. 7, 2011

(54) VALVE TIMING ADJUSTING APPARATUS CAPABLE OF RELIABLY PREVENTING HEAT DAMAGE OF SWITCHING ELEMENTS

(75) Inventor: Seiji Morino, Nagoya (JP)

(73) Assignee: Denso Corporation, Kariya (JP)

( * ) Notice: Subject to any disclaimer, the term of this patent is extended or adjusted under 35 U.S.C. 154(b) by 506 days.

(21) Appl. No.: 12/203,354

(22) Filed: Sep. 3, 2008

(65) Prior Publication Data

US 2009/0058344 A1 Mar. 5, 2009

(30) Foreign Application Priority Data

Sep. 4, 2007 (JP) ..... 2007-229376

(51) Int. Cl.
*F01L 1/34* (2006.01)

(52) U.S. Cl. ..... 318/484; 701/105; 123/90.15; 123/478

(58) Field of Classification Search ..... 318/461, 318/484, 599; 123/90.1, 90.11, 90.15, 90.17, 123/90.31, 478; 701/105
See application file for complete search history.

(56) References Cited

U.S. PATENT DOCUMENTS

| | | | | |
|---|---|---|---|---|
| 7,036,474 | B2 * | 5/2006 | Axmacher et al. | 123/90.31 |
| 7,177,759 | B2 * | 2/2007 | Nakamura | 701/114 |
| 7,448,351 | B2 * | 11/2008 | Mizuno | 123/90.15 |
| 7,631,623 | B2 * | 12/2009 | Mizuno | 123/90.17 |
| 7,743,743 | B2 * | 6/2010 | Inoue et al. | 123/90.17 |
| 7,802,545 | B2 * | 9/2010 | Mizuno | 123/90.15 |

FOREIGN PATENT DOCUMENTS

JP 2004-350446 9/2004

* cited by examiner

*Primary Examiner* — Bentsu Ro
(74) *Attorney, Agent, or Firm* — Nixon & Vanderhye PC

(57) ABSTRACT

A valve timing adjusting apparatus adjusts valve timing of at least one of intake and exhaust valves of an engine that are opened and closed by a camshaft driven by torque transmitted from a crankshaft. The apparatus includes an electric motor, a plurality of switching elements, a motor driver, and a phase adjusting mechanism. When a target rotational direction of a motor shaft of the electric motor is coincident with the actual rotational direction of the same, the motor driver continuously turns on a selected one of the switching elements for the whole of a predetermined rotation angle range of the motor shaft. When the target rotational direction is opposite to the actual rotational direction, the motor driver continuously turns on the selected switching element only for part of the rotation angle range, and continuously turns off the selected switching element for the remaining part of the rotation angle range.

14 Claims, 14 Drawing Sheets

FIG. 9

| | VOLTAGE LEVELS OF SENSING SIGNALS | | | | VOLTAGE LEVELS OF DRIVE SIGNALS | | | | | | | | | | | |
|---|---|---|---|---|---|---|---|---|---|---|---|---|---|---|---|---|
| | | | | | (a) | | | | | | (b) | | | | | |
| | | | | | HIGH-SIDE | | | LOW-SIDE | | | HIGH-SIDE | | | LOW-SIDE | | |
| | PATTERN | SU | SV | SW | FU | FV | FW | GU | GV | GW | FU | FV | FW | GU | GV | GW |
| R15 | i | L | H | L | H | L | L | L | P | L | H | L | L | L | P | L |
| R15 | ii | L | H | H | H | L | L | L | L | P | L | L | L | L | L | P |
| R15 | iii | L | L | H | L | H | L | L | L | P | L | H | L | L | L | P |
| R15 | F iv B | H | L | H | L | H | L | P | L | L | L | L | L | P | L | L |
| R15 | v | H | L | L | L | L | H | P | L | L | L | L | H | P | L | L |
| R15 | vi | H | H | L | L | L | H | L | P | L | L | L | L | L | P | L |

F FORWARD B BACKWARD

FIG. 10

| | VOLTAGE LEVELS OF SENSING SIGNALS | | | | VOLTAGE LEVELS OF DRIVE SIGNALS | | | | | | | | | | | |
|---|---|---|---|---|---|---|---|---|---|---|---|---|---|---|---|---|
| | | | | | (a) | | | | | | (b) | | | | | |
| | | | | | HIGH-SIDE | | | LOW-SIDE | | | HIGH-SIDE | | | LOW-SIDE | | |
| | PATTERN | SU | SV | SW | FU | FV | FW | GU | GV | GW | FU | FV | FW | GU | GV | GW |
| R15 | i | L | H | L | L | H | L | P | L | L | L | L | L | P | L | L |
| R15 | ii | L | H | H | L | L | H | P | L | L | L | L | H | P | L | L |
| R15 | iii | L | L | H | L | L | H | L | P | L | L | L | L | L | P | L |
| R15 | F iv B | H | L | H | H | L | L | L | P | L | H | L | L | L | P | L |
| R15 | v | H | L | L | H | L | L | L | L | P | L | L | L | L | L | P |
| R15 | vi | H | H | L | L | H | L | L | L | P | L | H | L | L | L | P |

F FORWARD B BACKWARD

| | VOLTAGE LEVELS OF SENSING SIGNALS | | | | VOLTAGE LEVELS OF DRIVE SIGNALS | | | | | | | | | | | |
|---|---|---|---|---|---|---|---|---|---|---|---|---|---|---|---|---|
| | | | | | (a) | | | | | | (b) | | | | | |
| | | | | | HIGH-SIDE | | | LOW-SIDE | | | HIGH-SIDE | | | LOW-SIDE | | |
| | PATTERN | SU | SV | SW | FU | FV | FW | GU | GV | GW | FU | FV | FW | GU | GV | GW |
| R15 | i | L | H | L | H | L | L | L | P | L | L | L | H | L | P | L |
| R15 | ii | L | H | H | H | L | L | L | L | P | H | L | L | L | P | L |
| R15 | iii | L | L | H | L | H | L | L | L | P | H | L | L | L | L | P |
| R15 | F iv B | H | L | H | L | H | L | P | L | L | L | H | L | L | L | P |
| R15 | v | H | L | L | L | L | H | P | L | L | L | H | L | P | L | L |
| R15 | vi | H | H | L | L | L | H | L | P | L | L | L | H | P | L | L |

F FORWARD B BACKWARD

| | VOLTAGE LEVELS OF SENSING SIGNALS | | | | VOLTAGE LEVELS OF DRIVE SIGNALS | | | | | | | | | | | |
|---|---|---|---|---|---|---|---|---|---|---|---|---|---|---|---|---|
| | | | | | (a) | | | | | | (b) | | | | | |
| | | | | | HIGH-SIDE | | | LOW-SIDE | | | HIGH-SIDE | | | LOW-SIDE | | |
| | PATTERN | SU | SV | SW | FU | FV | FW | GU | GV | GW | FU | FV | FW | GU | GV | GW |
| R15 | i | L | H | L | L | H | L | P | L | L | L | L | H | P | L | L |
| R15 | ii | L | H | H | L | L | H | P | L | L | L | L | H | L | P | L |
| R15 | iii | L | L | H | L | L | H | L | P | L | H | L | L | L | P | L |
| R15 | (F) iv (B) | H | L | H | H | L | L | L | P | L | H | L | L | L | L | P |
| R15 | v | H | L | L | H | L | L | L | L | P | L | H | L | L | L | P |
| R15 | vi | H | H | L | L | H | L | L | L | P | L | H | L | P | L | L |

(F) FORWARD (B) BACKWARD

VALVE TIMING ADJUSTING APPARATUS CAPABLE OF RELIABLY PREVENTING HEAT DAMAGE OF SWITCHING ELEMENTS

CROSS-REFERENCE TO RELATED APPLICATION

This application is based on and claims priority from Japanese Patent Application No. 2007-229376, filed on Sep. 4, 2007, the content of which is hereby incorporated by reference in its entirety into this application.

BACKGROUND OF THE INVENTION

1 Technical Field of the Invention

The present invention relates to a valve timing adjusting apparatus for an internal combustion engine, which adjusts valve timing of at least one of intake and exhaust valves of the engine that are opened and closed by a camshaft driven by torque transmitted from a crankshaft of the engine.

2 Description of the Related Art

There have been known valve timing adjusting apparatuses for internal combustion engines, which adjust, with a phase adjusting mechanism connected to a motor shaft, the relative phase of a camshaft to a crankshaft according to the rotational condition of the motor shaft.

For example, Japanese Patent First Publication No. 2004-350446 discloses such a valve timing adjusting apparatus. More specifically, in the apparatus, there are provided a plurality of switching elements that are connected to stator windings of a motor; the stator windings create a magnetic field upon being energized. The apparatus drives a motor shaft, on which the created magnetic field acts, by shifting those of the switching elements which are turned on according to predetermined rotation angle ranges of the motor shaft.

However, in the above apparatus, induced voltage will be generated in the stator windings when the motor shaft rotates in the magnetic field created by the stator windings Further, when a target rotational direction of the motor shaft, which determines the shift sequence of the turned-on switching elements, is coincident with the actual rotational direction of the motor shaft/the direction of the induced voltage will be opposite to that of the voltage which is applied to the stator windings upon turning on those switching elements. Consequently, current corresponding to the difference between the applied and induced voltages will flow through the turned-on switching elements.

On the other hand, when the target rotational direction of the motor shaft is opposite to the actual rotational direction, the direction of the induced voltage will be coincident with that of the voltage applied to the stator windings. Consequently, large current corresponding to the sum of the applied and induced voltages will flow through the turned-on switching elements; this may cause the turned-on switching elements to be damaged due to overheating. Further, since the shift of the turned-on switching elements is made according to the rotation angle ranges of the motor shaft, the turned-on switching elements become more easily damaged as the rotational speed of the motor shaft increases.

SUMMARY OF THE INVENTION

According to the present invention, there is provided a first valve timing adjusting apparatus for an internal combustion engine. The first valve timing adjusting apparatus adjusts valve timing of at least one of intake and exhaust valves of the engine that are opened and closed by a camshaft driven by torque transmitted from a crankshaft of the engine. The first valve timing adjusting apparatus includes an electric motor, a plurality of switching elements, a motor driver, and a phase adjusting mechanism. The electric motor includes a plurality of stator windings, which create a magnetic field upon being energized, and a motor shaft that is caused by the magnetic field to rotate in one of a normal direction and a reverse direction. The motor shaft has a plurality of predetermined rotation angle ranges. Each of the switching elements is electrically connected to a corresponding one of the stator windings. The motor driver drives the electric motor by selecting, for each of the rotation angle ranges of the motor shaft, one of the switching elements and turning on the selected switching element in the rotation angle range. The phase adjusting mechanism adjusts the relative phase of the camshaft to the crankshaft according to the rotational condition of the motor shaft. Further, in the first valve timing adjusting apparatus, when a target rotational direction of the motor shaft is coincident with the actual rotational direction of the motor shaft, the motor driver continuously turns on the selected switching element for the whole of the rotation angle range; when the target rotational direction of the motor shaft is opposite to the actual rotational direction of the motor shaft, the motor driver continuously turns on the selected switching element only for part of the rotation angle range, and continuously turns off the selected switching element for the remaining part of the rotation angle range.

According to the present invention, there is also provided a second valve timing adjusting apparatus for an internal combustion engine. The second valve timing adjusting apparatus adjusts valve timing of at least one of intake and exhaust valves of the engine that are opened and closed by a camshaft driven by torque transmitted from a crankshaft of the engine. The second valve timing adjusting apparatus includes an electric motor, a plurality of switching elements, a motor driver, and a phase adjusting mechanism. The electric motor includes a plurality of stator windings, which create a magnetic field upon being energized, and a motor shaft that is caused by the magnetic field to rotate in one of a normal direction and a reverse direction. The motor shaft has a plurality of predetermined rotation angle ranges. Each of the switching elements is electrically connected to a corresponding one of the stator windings. The motor driver drives the electric motor by selecting, for each of the rotation angle ranges of the motor shaft, one of the switching elements and turning on the selected switching element in the rotation angle range. The phase adjusting mechanism adjusts the relative phase of the camshaft to the crankshaft according to the rotational condition of the motor shaft. Further, in the second valve timing adjusting apparatus, when a target rotational direction of the motor shaft is coincident with the actual rotational direction of the motor shaft, the motor driver continuously turns on the selected switching element for the whole of the rotation angle range; when the target rotational direction of the motor shaft is opposite to the actual rotational direction of the motor shaft, the motor driver continuously turns on the selected switching element for the whole of a shifted rotation angle range that is obtained by shifting the rotation angle range in one of advancing and retarding directions.

BRIEF DESCRIPTION OF THE DRAWINGS

The present invention will be understood more fully from the detailed description given hereinafter and from the accompanying drawings of preferred embodiments of the invention, which, however, should not be taken to limit the invention to the specific embodiments but are for the purpose of explanation and understanding only.

In the accompanying drawings:

FIG. 9 is a schematic view illustrating the operations of the drive portion of the valve timing adjusting apparatus according to the first and second embodiments of the invention;

FIG. 10 is a schematic view illustrating the operations of the drive portion according to the first and second embodiments of the invention.

DESCRIPTION OF PREFERRED EMBODIMENTS

Figure 1:
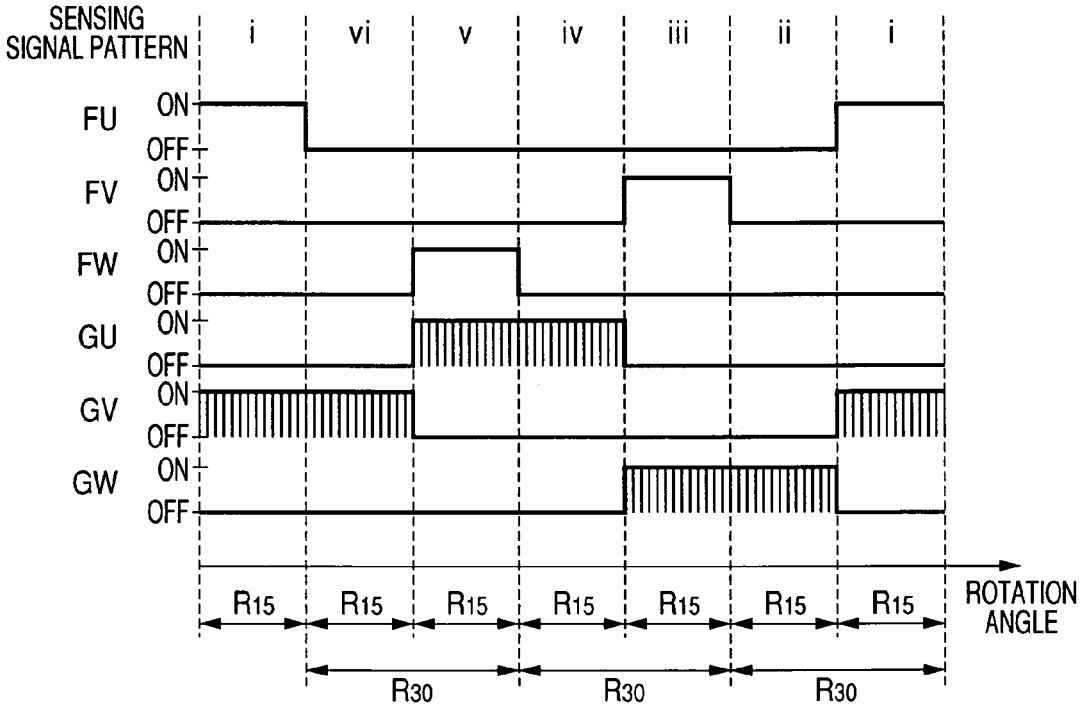
FIG. 1 is a schematic view illustrating an operation of a drive portion of a valve timing adjusting apparatus according to the first embodiment of the invention.

Preferred embodiments of the present invention will be described hereinafter with reference to FIGS. 1-19.

It should be noted that, for the sake of clarity and understanding, identical components having identical functions in different embodiments of the invention have been marked, where possible, with the same reference numerals in each of the figures.

First Embodiment

Figure 2:
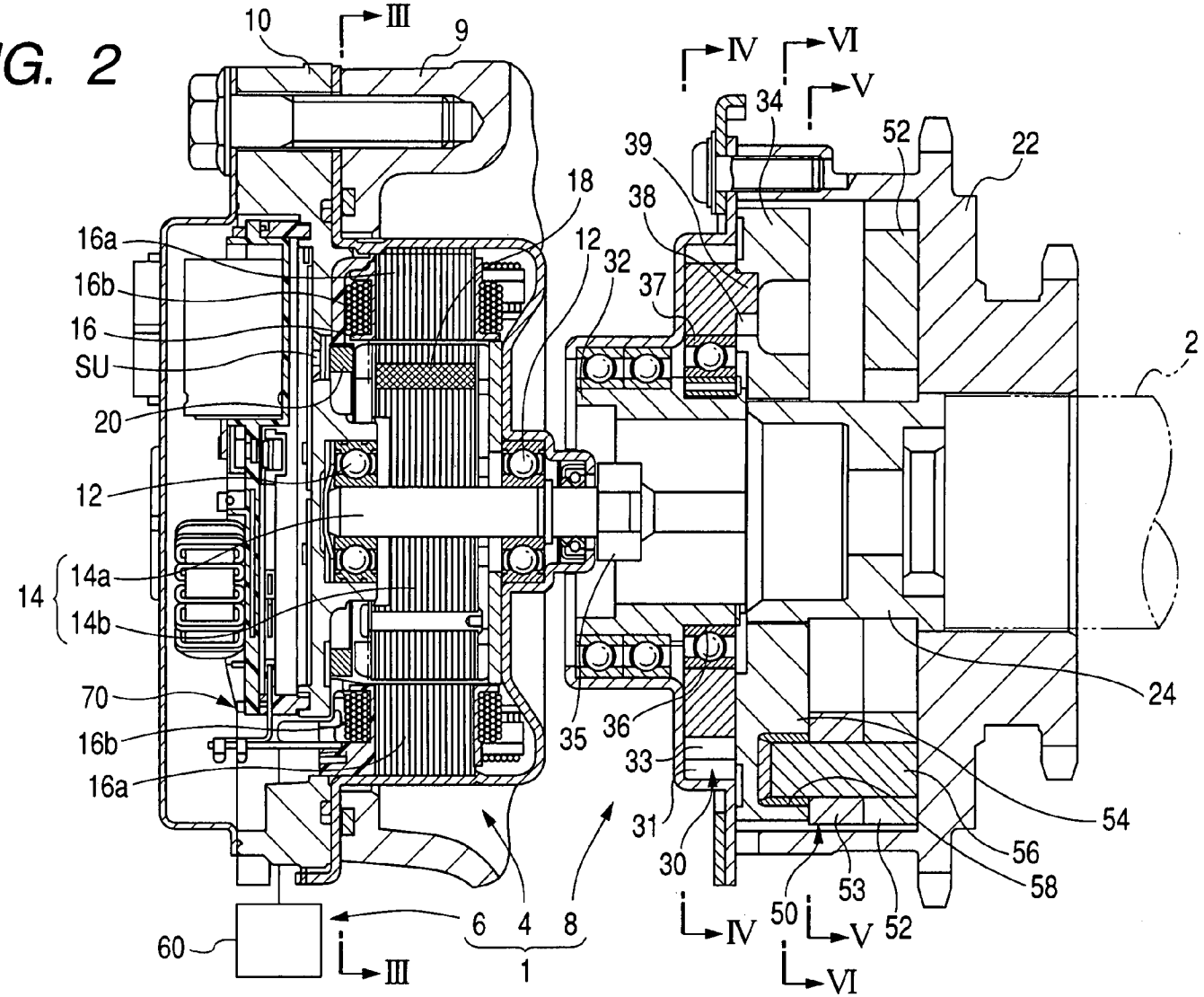
FIG. 2 is a partially cross-sectional view showing the overall configuration of the valve timing adjusting apparatus, which is taken along the line II-II in FIG. 5.

FIG. 2 shows the overall configuration of a valve timing adjusting apparatus 1 according to the first embodiment of the invention. The valve timing adjusting apparatus 1 is mounted on a motor vehicle, and incorporated in a transmission system which transmits torque generated by an internal combustion engine of the vehicle from a crankshaft (not shown) to a camshaft 2.

As shown in FIG. 2, the valve timing adjusting apparatus 1 includes an electric motor 4, a power supply control device 6, and a phase adjusting mechanism 8. In the present embodiment, the camshaft 2 is configured to open and close intake valves of the engine; the valve timing adjusting apparatus 1 is configured to adjust the valve timing of the intake valves which depend on the relative phase of the camshaft 2 to the crankshaft.

Figure 3:
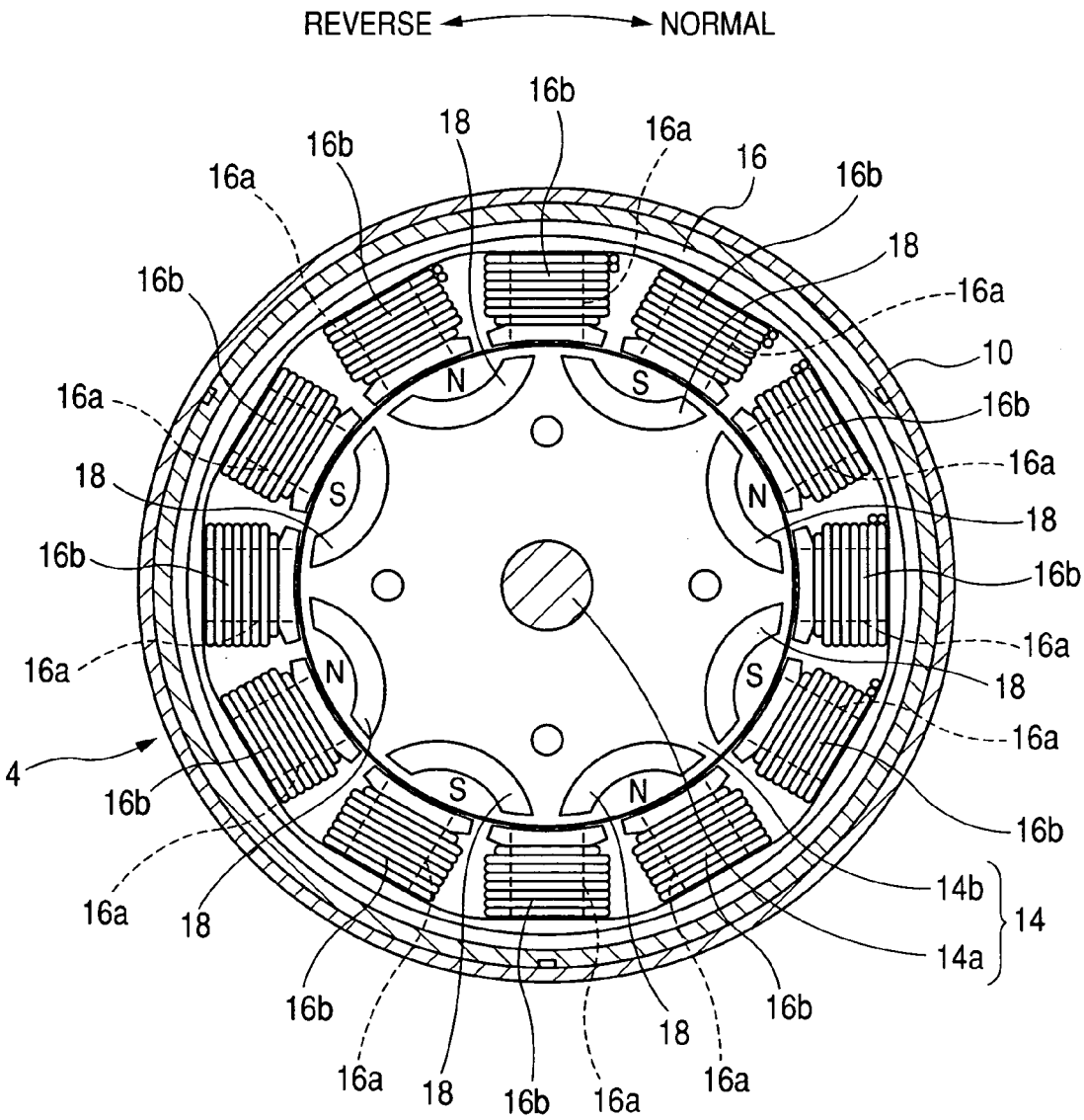
FIG. 3 is a cross-sectional view taken along the line III-III in FIG. 2.

The electric motor 4 is implemented by a brushless, permanent magnet and synchronous motor. As shown in FIGS. 2 and 3, the electric motor 4 includes a housing 10, a pair of bearings 12, a motor shaft 14, permanent magnets 18, and a motor stator 16. The housing 10 is secured to a fixed part (e.g., a chain case) 9 of the engine. In the housing 10, there are received and fixed the pair of bearings 12 and the motor stator 16. The bearings 12 together rotatably support a base portion 14*a* of the motor shaft 14. The motor shaft 14 further includes a rotor portion 14*b* that extends radially outward from the base portion 14*a*. The permanent magnets 18 are embedded in the rotor portion 14*b* of the motor shaft 14, and spaced in the circumferential direction of the motor shaft 14 at even intervals. Each circumferentially-adjacent pair of the permanent magnets 18 have opposite polarities on the radially outer periphery of the rotor portion 14*b*. The motor stator 16 includes stator cores 16*a* and stator windings 16*b*. The motor stator 16 surrounds the motor shaft 14 so as to be concentric with the motor shaft 14. The stator cores 16*a* are each formed by laminating thin iron sheets. The stator cores 16*a* are spaced in the circumferential direction of the motor stator 16 (i.e., the rotational direction of the motor shaft 14) at even intervals. On each of the stator cores 16*a*, there is wound a corresponding one of the stator windings 16*b*.

The power supply control device 6 is electrically connected to the stator windings 16*b* of the electric motor 4. The power supply control device 6 controls supply of electric power to the stator windings 16*b* according to the operating condition of the engine. Upon being energized under control of the power supply control device 6, the stator windings 16*b* create a magnetic field that acts on the permanent magnets 18. As a result, torque whose direction depends on the magnetic field is generated to act on the rotor portion 14*b*, thereby turning the motor shaft 14. In the present embodiment, with respect to rotation of the motor shaft 14, the clockwise and counterclockwise directions of FIG. 3 are respectively defined as normal and reverse rotational directions of the motor shaft 14.

The phase adjusting mechanism 8 includes, as shown in FIG. 2, a driving-side rotating member 22, a driven-side rotating member 24, a planetary gear train 30, and a link unit 50.

The driving-side rotating member 22 is a timing sprocket, on which runs a timing chain (not shown) that is looped between the crankshaft and the driving-side rotating member 22. The driving-side rotating member 22 receives engine torque from the crankshaft via the timing chain, thereby rotating in the clockwise directions of FIGS. 5 and 6.

Figure 5:
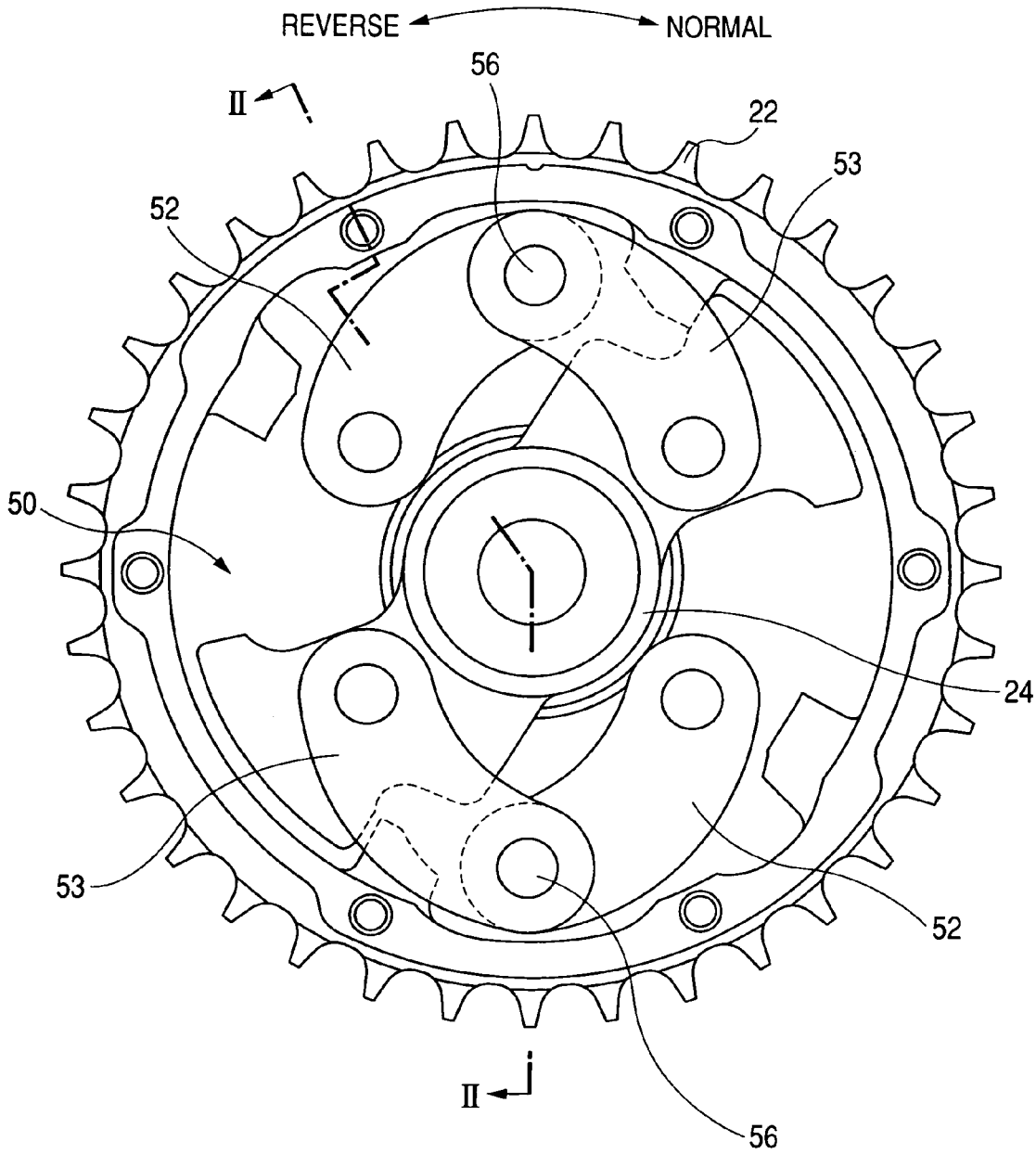
FIG. 5 is a cross-sectional view taken along the line V-V in FIG. 2.
Figure 6:
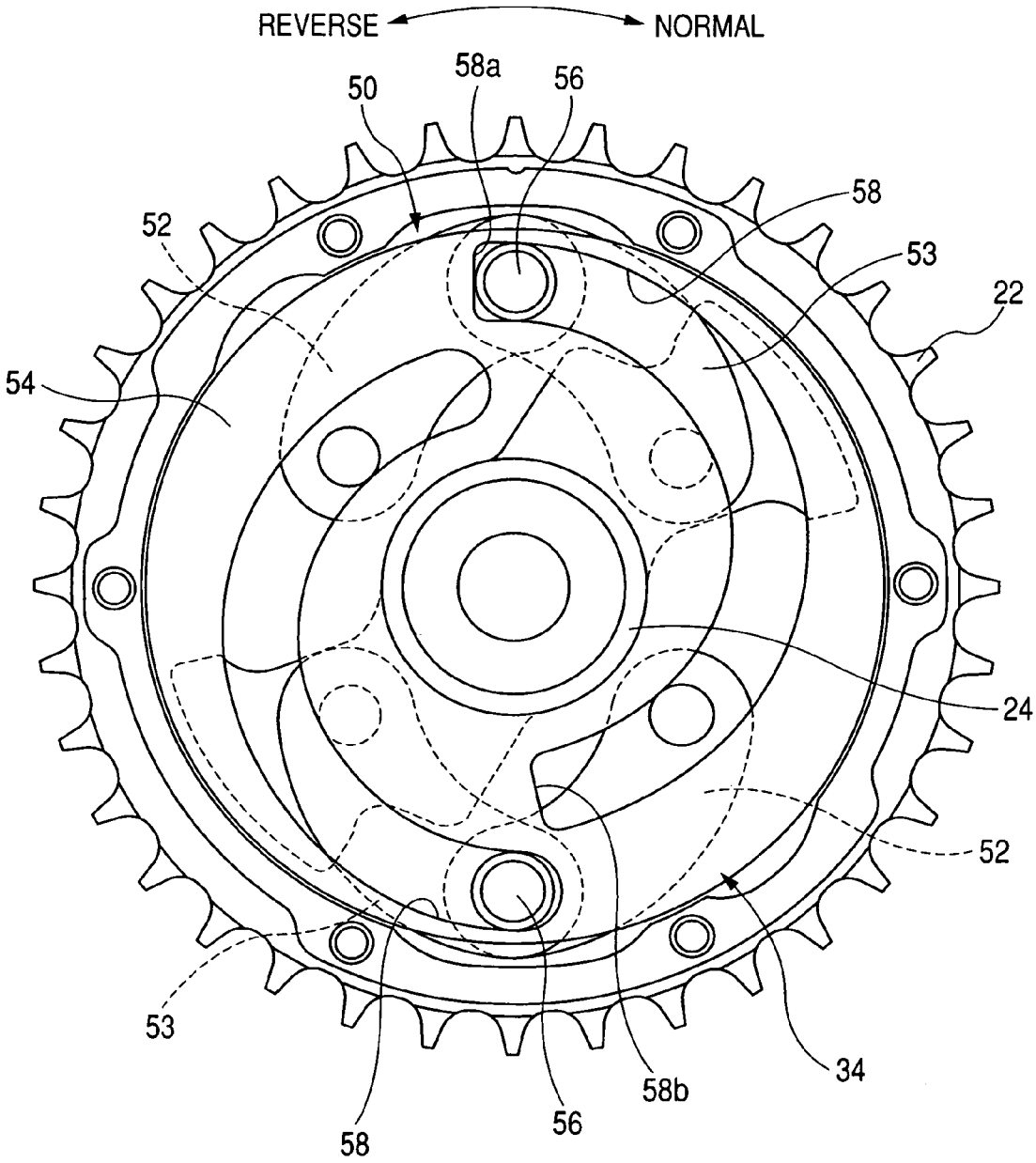
FIG. 6 is a cross-sectional view taken along the line VI-VI in FIG. 2.

The driven-side rotating member 24 is coaxially connected to the camshaft 2, and rotates along with the camshaft 2 in the clockwise directions of FIGS. 5 and 6.

In the present embodiment, the normal rotational direction of the motor shaft 14 is coincident with the rotational direction of the engine; the reverse rotational direction of the motor shaft 14 is opposite to the rotational direction of the engine.

Figure 4:
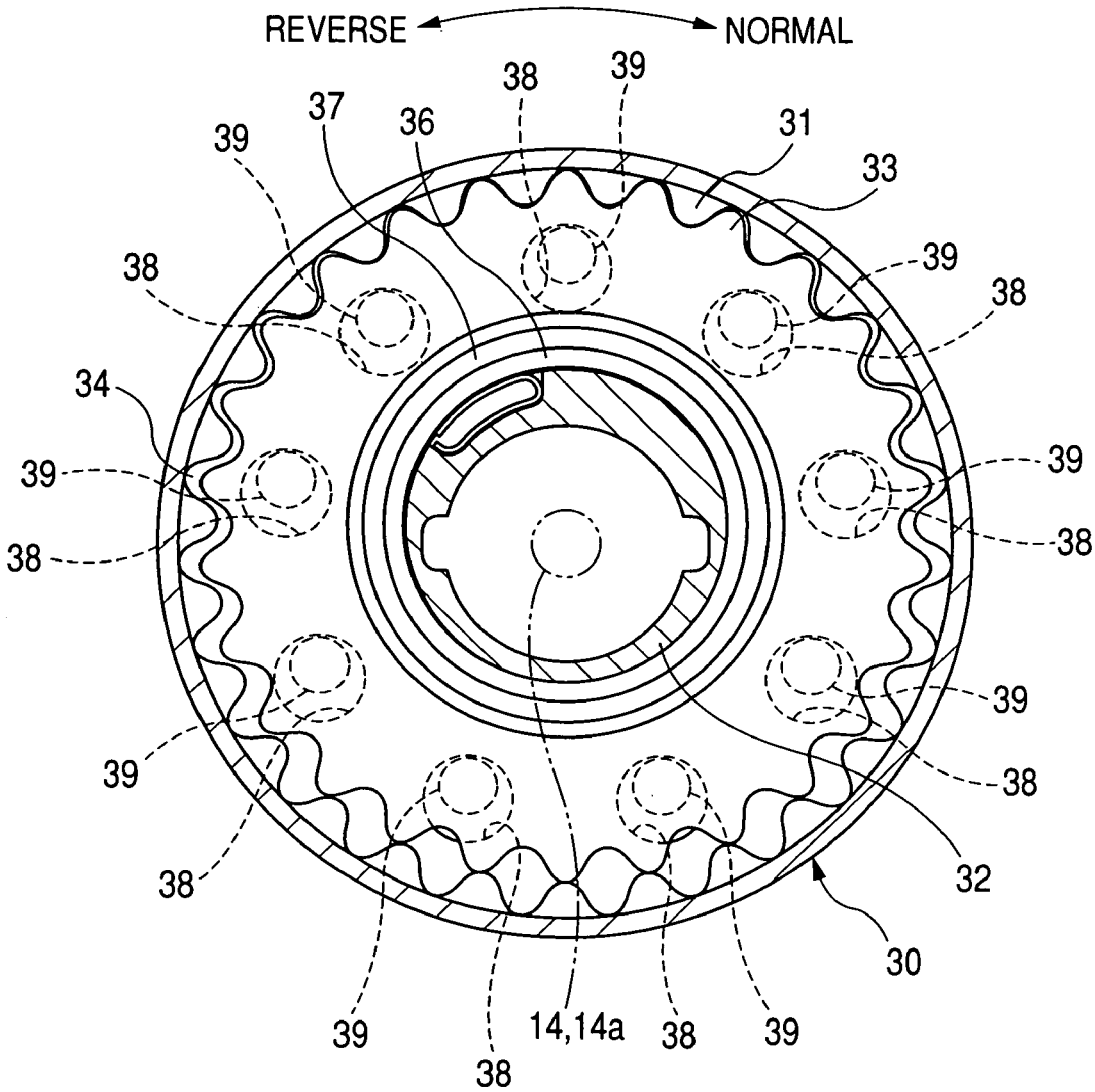
FIG. 4 is a cross-sectional view taken along the line IV-IV in FIG. 2.

The planetary gear train 30 includes, as shown in FIGS. 2 and 4, a sun gear 31, a planet carrier 32 functioning as an "input rotating member", a planetary gear 33, and a transmitting member 34. The sun gear 31 is made up of an internal gear. The sun gear 31 is coaxially fixed to the driving-side rotating member 22 with screws, so as to rotate with the driving-side rotating member 22 in the normal direction. The planet carrier 32 is connected to the base portion 14*a* of the motor shaft 14 via a coupling 35, so as to rotate with the motor shaft 14 in both the normal and reverse directions. The planet gear carrier 32 includes an eccentric portion 36 that is formed with a cylindrical outer surface eccentric to the driving-side rotating member 22. The planet gear 33 is made up of an external gear. The planet gear 33 is fitted on and supported by the eccentric portion 36 of the planet gear carrier 32 via a bearing 37. The planet gear 33 is so arranged as to be eccentric to the sun gear 31. The planet gear 33 meshes with the sun gear 31 from the radially inner side of the sun gear 31. The planet gear 33 makes a planetary movement with a relative rotation of the planet carrier 32 to the sun gear 31.

The transmitting member 34 is coaxially fitted on the outer surface of the driven-side rotating member 24. The transmitting member 34 has a plurality of engaging holes 38 that are spaced in the circumferential direction of the transmitting member 34 at even intervals. On the other hand, the planet gear 33 has a plurality of engaging protrusions 39 that protrude from an axial end face of the planet gear 33 facing the transmitting member 34 and are spaced in the circumferential direction of the planet gear 33 at even intervals. Each of the engaging protrusions 39 of the planet gear 33 is inserted in a corresponding one of the engaging holes 38 of the transmitting member 34. With the engagement between the engaging holes 38 and the engaging protrusions 39, the planetary movement of the planet gear 33 is extracted and converted into a rotational movement of the transmitting member 34.

The ink unit 50 includes, as shown in FIGS. 2, 5, and 6, two first links 52, two second links 53, a guide portion 54, and two movable members 56. It should be noted that hatching that represents a cross-section is omitted from FIGS. 5 and 6. Each of the first links 52 is connected to the driving-side rotating member 22 by, for example, a connecting pin or a rotary joint to form a revolute joint. On the other hand, each of the second links 53 is connected the driven-side rotating member 24 by, for example, a connecting pin or a rotary joint to form a revolute joint. Further, each of the first links 52 is connected to a corresponding one of the second links 53 by a corresponding one of the movable members 56. The guide portion 54 is made up of part of the transmitting member 34; the part includes an axial end face of the transmitting member 34 not facing the planet gear 33. In the guide portion 54, there are formed two guide grooves 58, in each of which a corresponding one of the movable members 56 is slidably disposed. Each of the guide grooves 58 is a spiral groove whose distance from the rotation center of the guide portion 54 changes along its longitudinal direction.

With the above configuration, the phase adjusting mechanism 8 operates according to the rotational condition of the motor shaft 14 and the planet carrier 32, thereby adjusting the relative phase of the camshaft 2 to the crankshaft.

More specifically, when both the motor shaft 14 and the planet carrier 32 rotate at the same speed as the driving-side rotating member 22 in the normal direction, there is no relative rotation between the planet carrier 32 and the sun gear 31. Then, the planet gear 33 rotates along with the rotating members 22 and 34, without making the planetary movement. Consequently, the movable members 56 are not guided in the corresponding guide grooves 58, and thus the relative position between the links 52 and 53 remain unchanged. As a result, both the motor shaft 14 and the phase adjusting mechanism 8 rotate along with the driving-side rotating member 22, thereby keeping the relative phase of the camshaft 2 to the crankshaft unchanged.

On the other hand, when both the motor shaft 14 and the planetary carrier 32 rotate at a lower speed than the driving-side rotating member 22 in the normal direction or rotate in the reverse direction, the planetary carrier 32 rotates relative to the sun gear 31. Then, the planetary gear 33 makes the planetary movement, so that the transmitting member 34 rotates relative to the driving-side rotating member 22 in an advancing direction (i.e., the clockwise direction of FIG. 6). Consequently, the movable members 56 are guided in the corresponding guide grooves 58, changing the relative position between the first links 52 and the second links 53. As a result, the driven-side rotating member 24 rotates relative to the driving-side rotating member 22 in a retarding direction (i.e., the counterclockwise direction of FIG. 5), thereby retarding the phase of the camshaft 2 relative to the crankshaft.

Otherwise, when both the motor shaft 14 and the planetary carrier 32 rotate at a higher speed than the driving-side rotating member 22, the planetary carrier 32 rotates relative to the sun gear 31. Then, the planetary gear 33 makes the planetary movement, so that the transmitting member 34 rotates relative to the driving-side rotating member 22 in the retarding direction (i.e., the counterclockwise direction of FIG. 6). Consequently the movable members 56 are guided in the corresponding guide grooves 58, changing the relative position between the first links 52 and the second links 53. As a result, the driven-side rotating member 24 rotates relative to the driving-side rotating member 22 in the advancing direction (i.e., the clockwise direction of FIG. 5), thereby advancing the phase of the camshaft 2 relative to the crankshaft.

After having described the overall configuration of the valve timing adjusting apparatus 1, the distinctive features of the same will be described hereinafter.

First, with respect to the link unit 50, one of the guide grooves 58 is, as shown in FIG. 6, defined by two end walls that function as stoppers 58*a* and 58*b*, respectively.

When the stopper 58*a* abuts the outer surface of the corresponding movable member 56, as shown in FIG. 6, the rotational movement of the motor shaft 14 and the planet carrier 32, which causes the transmitting member 34 to rotate relative to the driving-side rotating member 22 in the advancing direction, is stopped by the stopper 58*a*. Consequently, the relative rotation of the driven-side rotating member 24 to the driving-side rotating member 22 in the retarding direction is also stopped. As a result, the relative phase of the camshaft 2 to the crankshaft is set to the most-retarded value.

On the other hand, when the stopper 58*b* abuts the outer surface of the corresponding movable member 56, the rotational movement of the motor shaft 14 and the planet carrier 32, which causes the transmitting member 34 to rotate relative to the driving-side rotating member 22 in the retarding direction, is stopped by the stopper 58*b*. Consequently, the relative rotation of the driven-side rotating member 24 to the driving-side rotating member 22 in the advancing direction is also stopped. As a result, the relative phase of the camshaft 2 to the crankshaft is set to the most-advanced value.

Figure 7:
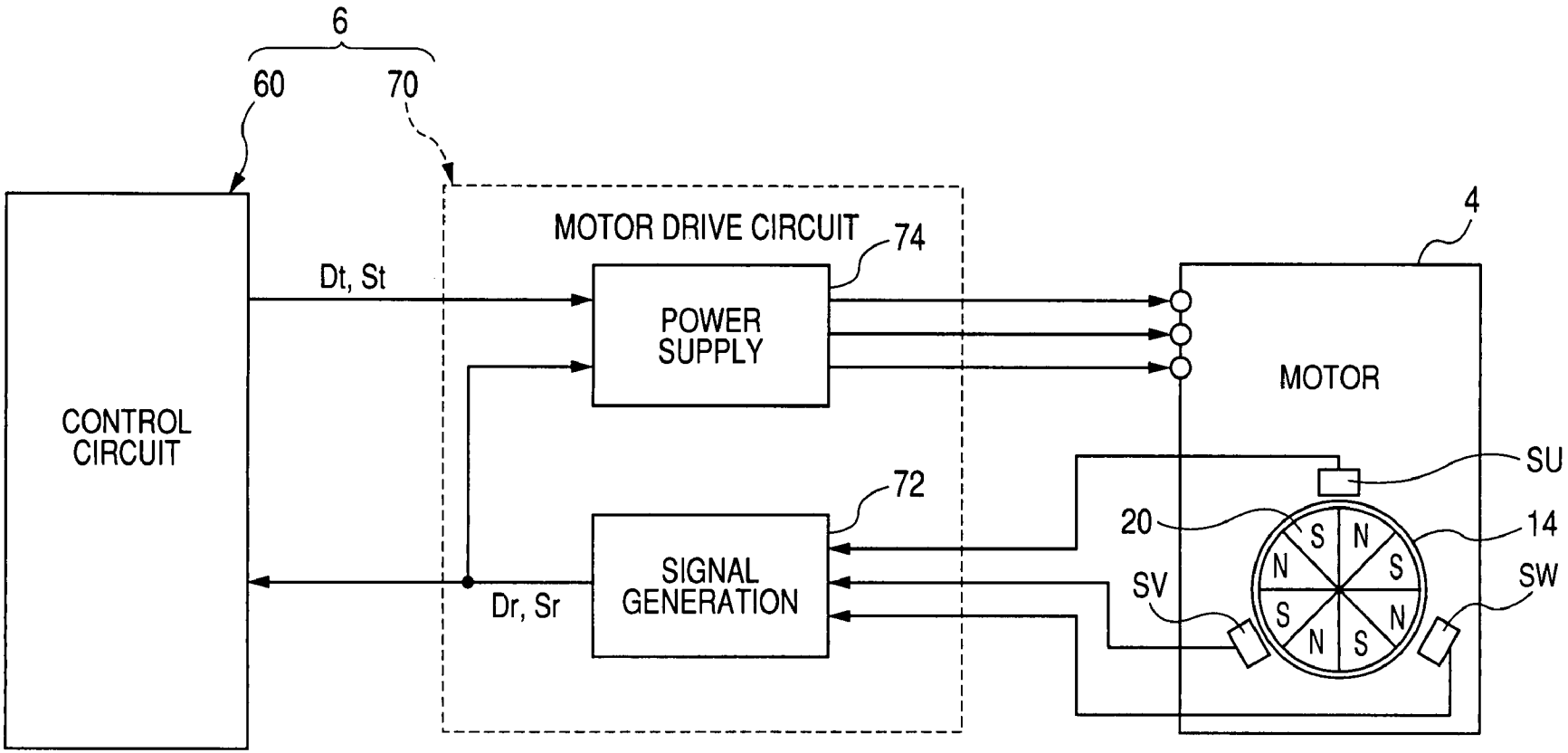
FIG. 7 is a functional block diagram showing the configuration of a power supply control device of the valve timing adjusting apparatus.

Secondly, in the present embodiment, the electric motor 4 further includes, as shown in FIGS. 2 and 7, three rotation angle sensors SU, SV, and SW that are spaced in the rotational direction of the motor shaft 14 at even intervals of 120°.

Each of the rotation angle sensors SU, SV, and SW is configured with, for example, a Hall element. Each of the rotation angle sensors SU, SV, and SW senses the rotation angle θ of the motor shaft 14 by sensing the magnetic field created by sensor magnets 20 that are mounted on the motor shaft 14, and outputs a sensing signal indicative of the sensed rotation angle θ.

Thirdly, in the present embodiment, the power supply control device 6 includes a control circuit 60 and a motor drive circuit 70. The control circuit 60 is disposed outside the electric motor 4, while the motor drive circuit 70 is disposed inside the electric motor 4, It should be appreciated that the control circuit 60 and the motor drive circuit 70 may be disposed together either outside or inside the electric motor 4.

The control circuit 60 is configured with, for example, a microcomputer. The control circuit 60 is, as shown in FIG. 7, electrically connected to the motor drive circuit 70. The control circuit 60 controls the operation of the engine as well as the power supply to the electric motor 4.

The control circuit 60 determines the actual valve timing of the intake valves based on the actual rotational direction Dr and actual rotational speed Sr of the motor shat 14 provided by the motor drive circuit 70. The control circuit 60 also sets a target valve timing of the intake valves based on the operating condition of the engine. Further, the control circuit 60 sets a target rotational direction Dt and a target rotational speed St of the motor shaft 14 based on the difference between the actual and target valve timings. Then, the control circuit 60 outputs a control signal, which indicates the set target rotational direction Dt and target rotational speed St, to the motor drive circuit 70.

The motor drive circuit 70 includes a signal generation block 72 and a power supply block 74. In the present embodiment, each of the blocks 72 and 74 is implemented by hardware, more particularly by a dedicated electric circuit element.

The signal generation block 72 is electrically connected to each of the rotation angle sensors SU, SV, and SW of the electric motor 4 as well as to the control circuit 60 and the power supply block 74, The signal generation block 72 determines the actual rotational direction Dr and actual rotational speed Sr of the motor shaft 14 based on the sensing signals that are output from the rotation angle sensors SU, SV, and SW and indicate the rotation angle θ of the motor shaft 14. Then, the signal generation block 72 outputs a motor rotation signal, which indicates the determined actual rotational direction Dr and actual rotational speed Sr of the motor shaft 14, to the control circuit 60 and the power supply block 74.

Figure 8:
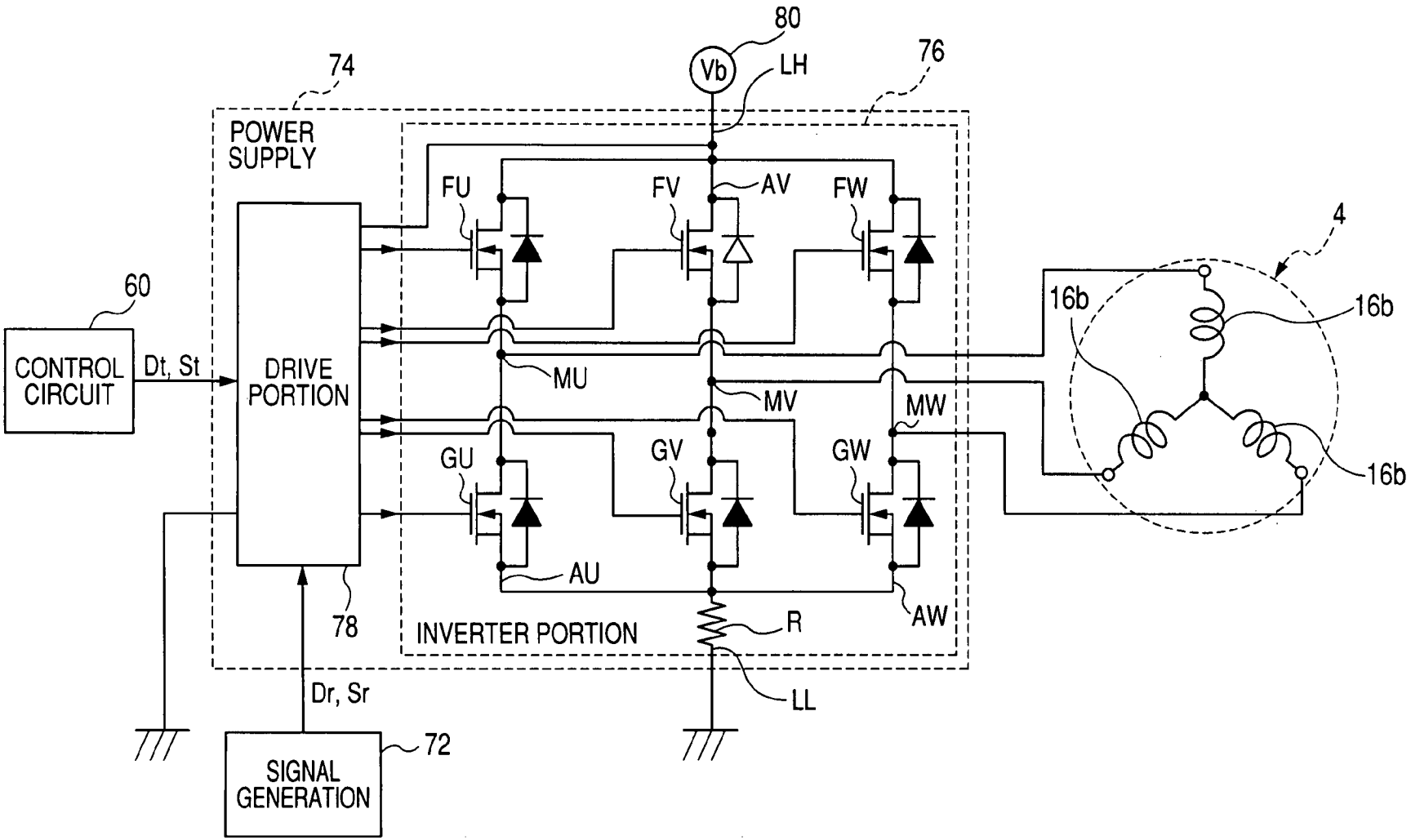
FIG. 8 is a functional block diagram showing the configuration of a power supply block of the power supply control device.

The power supply block 74 includes, as shown in FIG. 8, an inverter portion 76 and a drive portion 78.

The inverter portion 76 is a three-phase bridge circuit that has three arms AU, AV, and AW. The arm AU includes a high-side switching element FU and a low-side switching element GU that are electrically connected to each other. The arm AU includes a high-side switching element FV and a low-side switching element GV that are electrically connected to each other. The arm AW includes a high-side switching element FW and a low-side switching element GW that are electrically connected to each other. The high-side switching elements FU, FV, and FW are each electrically connected to a battery 80 of the vehicle via a high-side power line LH. On the other hand, the low-side switching elements GU, GV, and GW are each grounded via a shunt resistor R and a low-side power line LL. With the above configuration, the high-side switching elements FU, FV, and FW are respectively connected to the low-side switching elements GU, GV, and GW in series with respect to the battery 80.

In the present embodiment, each of the switching elements FU, FV, FW, GU, GV, and GW is implemented by a FET (Field Effect Transistor). Each of the switching elements FU, FV, FW, GU, GV, and GW is turned on by a high-level drive signal and off by a low-level drive signal. The midpoint MU between the switching elements FU and GU, the midpoint MV between the switching elements FV and GV, and the midpoint MW between the switching elements FW and GW are respectively connected to corresponding ones of the stator windings 16*b* that are star-connected.

The drive portion 78 is implemented by an IC (Integrated Circuit) in the present embodiment. The drive portion 78 is electrically connected to the control circuit 60, the signal generation block 72, and each of the switching elements FU, FV, FW, GU, GV, and GW.

The drive portion 78 turns on and off each of the switching elements FU, FV, FW, GU, GV, and GW based on the target rotational direction Dt and target rotational speed St provided by the control circuit 60 and the actual rotational direction Dr and actual rotational speed Sr provided by the signal generation block 72. As a result, the stator windings 16*b* are energized in a predetermined sequence to generate torque that acts on the rotor portion 14*b*, thereby driving the motor shaft 14.

In addition, when the target rotational direction Dt of the motor shaft 14 is coincident with the actual rotational direction Dr, induced voltage is generated in each of the stator windings 16*b* in the opposite direction to the voltage applied by the drive portion 78 to the each of the stator windings 16*b*. However, when the target rotational direction Dt of the motor shaft 14 is opposite to the actual rotational direction Dr, induced voltage is generated in each of the stator windings 16*b* in the same direction as the voltage applied by the drive portion 78 to the each of the stator windings 16*b*.

Next, an operation of the valve timing adjusting apparatus 1 according to the present embodiment will be described.

In the present embodiment, each of the rotation angle sensors SU, SV, and SW is turned on when any N pole of the sensor magnets 20 is within its sensing range, thereby making the voltage level of the sensing signal output therefrom high. Moreover, each of the rotation angle sensors SU, SV, and SW is turned off when any S pole of the sensor magnets 20 is within its sensing range, thereby making the voltage level of the sensing signal output therefrom low.

With the above configuration, as shown in FIG. 9, there are six combination patterns i-vi of the voltage levels of the sensing signals output from the rotation angle sensors SU, SV, and SW (to be referred to as sensing signal patterns hereinafter). The six sensing signal patterns are shifted for every rotation angle range $R_{15}$ of 15° for the motor shaft 14.

Figures 13, 14:
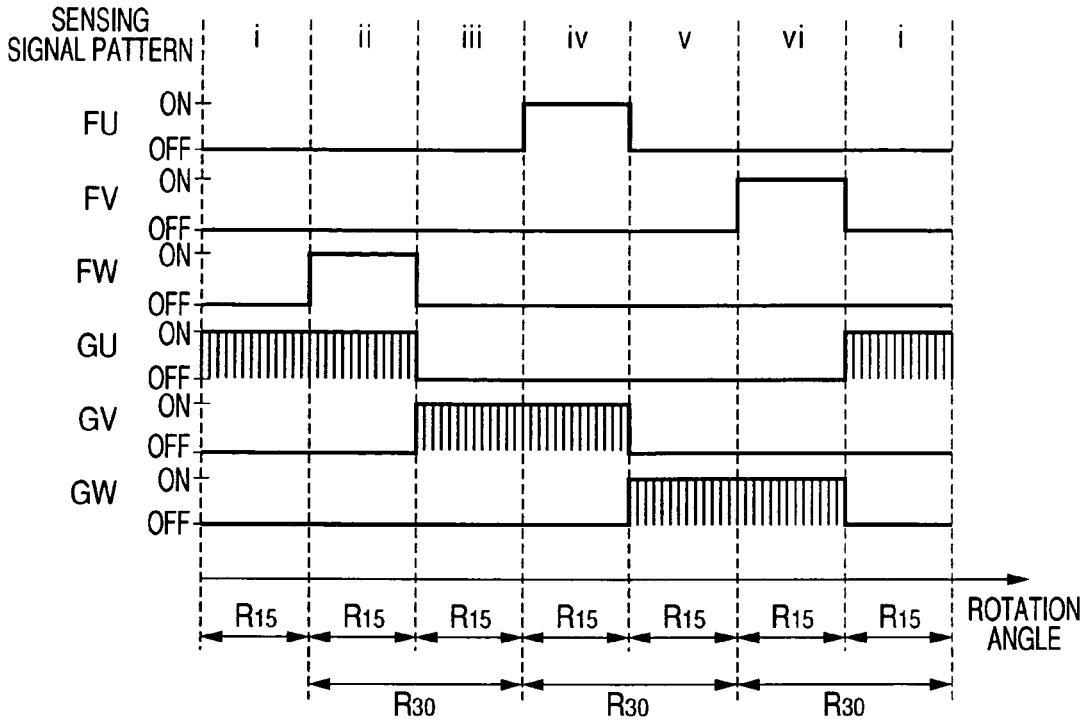
FIGS. 14, 15, 16, 17, 18, and 19 are schematic views illustrating the operation of the drive portion according to the third embodiment of the invention.
Figures 15, 16:
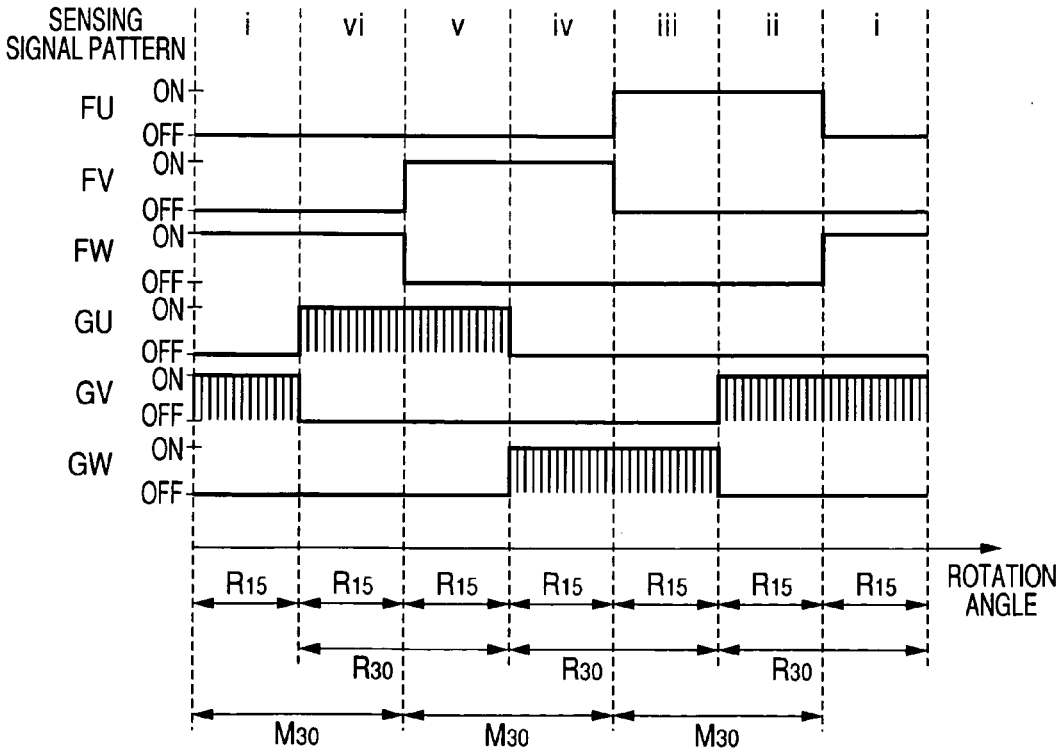

It should be noted that in FIG. 9 and subsequent FIGS. 10, 14, and 15, the voltage level of each of the sensing signals output from the rotation angle sensors SU, SV, and SW is indicated by "H" when it is high and by "L" when it is low.

Further, as shown in FIG. 9, the drive portion 78 controls the torque that acts on the motor shaft 14 by shifting six combination patterns of the voltage levels of the drive signals for the switching elements FU, FV, FW, GU, GV, and GW (to be referred to as drive signal patterns hereinafter).

It should be noted that in FIG. 9 and subsequent FIGS. 10, 14, and 15, the voltage level of each of the drive signals for the switching elements FU, FV, FW, GU, GV, and GW is indicated by "H" when it is kept high in the rotation angle range $R_{15}$, by "L" when it is kept low in the rotation angle range $R_{15}$, and by "L", when it is pulse-width-modulated in the rotation angle range $R_{15}$.

More specifically, when both the target and actual rotational directions Dt and Dr of the motor shaft 14 are coincident with the normal direction, the drive portion 78 shifts the drive signal patterns in Column (a) of FIG. 9 in the forward direction according to the sensing signal patterns i to vi, thereby generating normal-direction torque to act on the motor shaft 14 rotating in the normal direction.

Moreover, when both the target and actual rotational directions Dt and Dr of the motor shaft 14 are coincident with the reverse direction, the drive portion 78 shifts the drive signal patterns in Column (a) of FIG. 10 in the backward direction according to the sensing signal pattern vi to i, thereby generating reverse-direction torque to act on the motor shaft 14 rotating in the revere direction.

Figure 11:
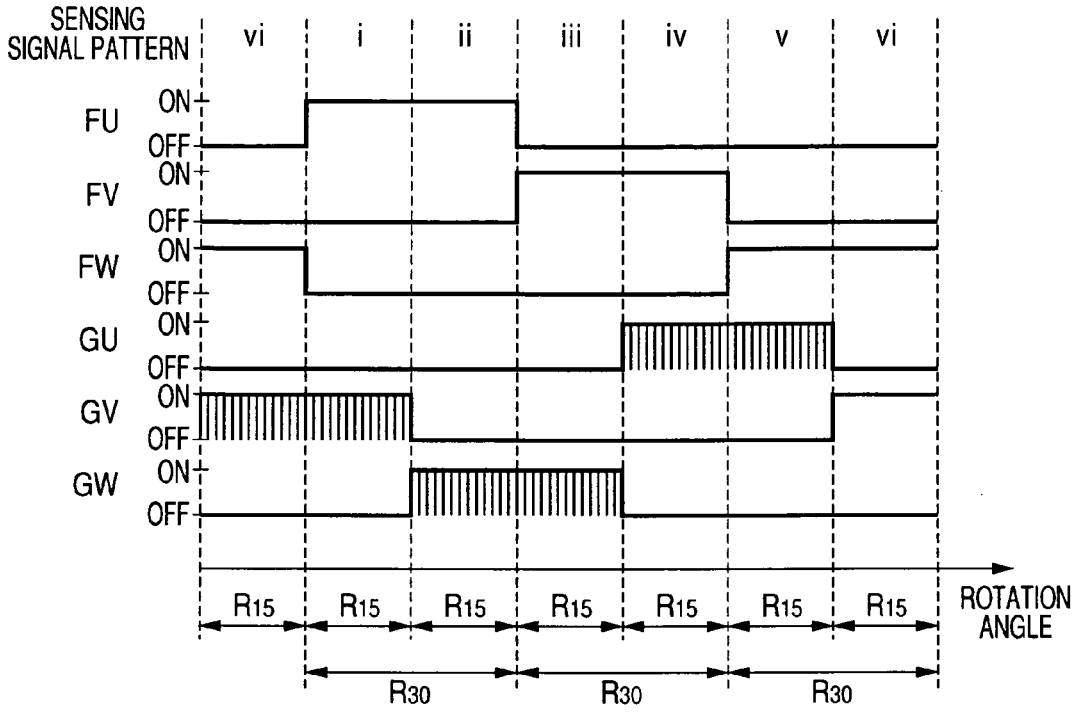
FIGS. 11, 12, and 13 are schematic views illustrating the operation of the drive portion according to the first embodiment of the invention.
Figure 12:
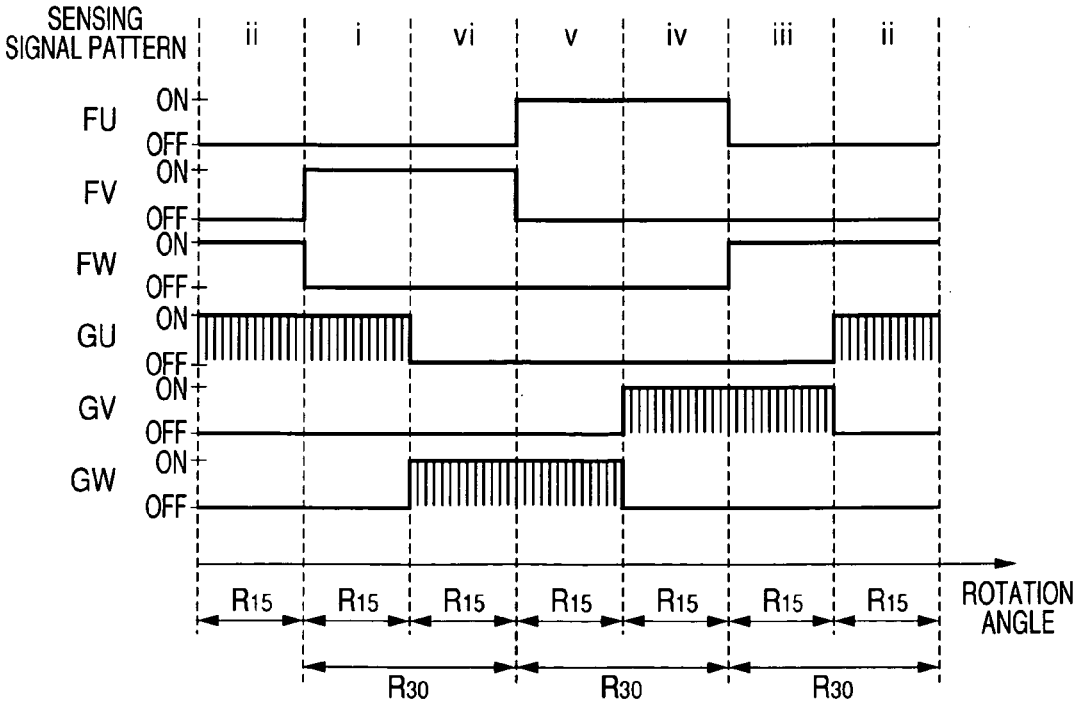

With the above operation, referring to FIGS. 11 and 12, when the target and actual rotational directions Dt and Dr are coincident with each other, for each rotation angle range $R_{30}$ of 30°, one of the high-side switching elements FU, FV, and FW is selected to be continuously turned on for the entire rotation angle range $R_{30}$. Hereinafter, the selected high-side switching element is simply referred to as selected switching element. Further, for each rotation angle range $R_{30}$, two of the low side switching elements GU, GV, and GW, which belong to different ones of the arms AU, AV, and AW from the selected switching element, are respectively pulse-width-modulated for different halves of the rotation angle range $R_{30}$. Hereinafter, the two low-side switching elements are simply referred as PWM switching elements.

Consequently, with the above operation, it is possible to effectively control power supply to the stator windings 16*b* by controlling the on/off operation of the PWM switching elements, thereby improving the responsiveness of the valve timing adjusting apparatus 1 in adjusting the relative phase of the camshaft 2 to the crankshaft.

On the other hand, when the target and actual rotational directions Dt and Dr of the motor shaft 14 are respectively coincident with the normal and reverse directions, the drive portion 78 shifts the drive signal patterns in Column (b) of FIG. 9 in the backward direction according to the sensing signal patterns vi to i, thereby generating normal-direction torque to brake the motor shaft 14 rotating in the reverse direction.

Moreover, when the target and actual rotational directions Dt and Dr of the motor shaft 14 are respectively coincident with the reverse and normal directions, the drive portion 78 shifts the drive signal patterns in Column (b) of FIG. 10 in the forward direction according to the sensing signal patterns i-vi, thereby generating reverse-direction torque to brake the motor shaft 14 rotating in the normal-direction.

With the above operation, referring to FIGS. 1 and 13, when the target and actual rotational directions Dt and Dr of the motor shaft 14 are opposite to each other, for each rotation angle range $R_{30}$ of 30°, the selected switching element from the high-side switching elements FU, FV, and FW is continuously turned on for one half of the rotation angle range $R_{30}$, and continuously turned off for the other half. Further, for each rotation angle range $R_{30}$, the two PWM switching elements from the low-side switching elements GU, GV, and GW belong to different ones of the arms AU, AV, and AW from the selected switching element.

Consequently, with the above operation, the stator windings 16*b* are energized only for halves of the corresponding rotation angle ranges $R_{30}$. Therefore, for each of the stator windings 16*b*, though the induced voltage is generated in the same direction as the voltage applied to the stator winding 16*b*, the time for which large current corresponding to the sum of the applied and induced voltages flows through the stator winding 16*b* is shortened. As a result, the selected switching elements from the high-side switching elements FU, FV, and FW are prevented from being damaged due to overheat.

In particular, when the relative phase of the camshaft 2 to the crankshaft is kept at the most-retarded value with the stopper 58*a* abutting the corresponding movable member 56, the target rotational direction Dt is set to the reverse direction to continuously brake the motor shaft 14 rotating in the normal direction. However, even in such a case, it is still possible to prevent heat damage of the selected switching elements with the operation of the valve timing adjusting apparatus 1 according to the present embodiment.

Second Embodiment

This embodiment is a modification of the first embodiment; therefore, only the difference from the first embodiment will be described hereinafter.

In the present embodiment, when the target and actual rotational directions Dt and Dr of the motor shaft 14 are respectively coincident with the normal and reverse directions, the drive portion 78 checks whether the actual rotational speed Sr of the motor shaft 14 is lower than a predetermined value Ss. If the actual rotational speed Sr is higher than or equal to the predetermined value Ss, then the drive portion 78 shifts the drive signal patterns in Column (b) of FIG. 9 in the backward direction. Otherwise, if the actual rotational speed Sr is lower than the predetermined value Ss, then the drive portion 78 shifts the drive signal patterns in Column (a) of FIG. 9 in the backward direction.

Moreover, when the target and actual rotational directions Dt and Dr of the motor shaft 14 are respectively coincident with the reverse and normal directions, the drive portion 78 checks whether the actual rotational speed Sr of the motor shaft 14 is lower than the predetermined value Ss. If the actual rotational speed Sr is higher than or equal to the predetermined value Ss, then the drive portion 78 shifts the drive signal patterns in Column (b) of FIG. 10 in the forward direction. Otherwise, if the actual rotational speed Sr is lower than the predetermined value Ss, then the drive portion 78 shifts the drive signal patterns in Column (a) of FIG. 10 in the forward direction.

With the above operation, when the actual rotational speed Sr of the motor shaft 14 is higher than or equal to the predetermined value Ss and the target and actual rotational directions Dt and Dr of the motor shaft 14 are opposite to each other, it is possible to prevent the selected switching elements from heat damage by the same principle as in the first embodiment.

On the other hand, when the actual rotational speed Sr of the motor shaft 14 is lower than the predetermined value Ss, the possibility of the selected switching elements being heat-damaged is low though the target and actual rotational directions Dt and Dr of the motor shaft 14 are opposite to each other. Therefore, with the above operation, the drive signal patterns are shifted in the same manner as in the case of the target and actual rotational directions Dt and Dr being coincident with each other, thereby improving the responsiveness of the valve timing adjusting apparatus 1 in adjusting the relative phase of the camshaft 2 to the crankshaft.

In other words, in the present embodiment, when the actual rotational speed Sr of the motor shaft 14 is lower than the predetermined value Ss, each of the selected switching elements is continuously turned on for the entire corresponding rotation angle range $R_{30}$ regardless of whether the target and actual rotational directions Dt and Dr of the motor shaft 14 are coincident with or opposite to each other.

In addition, the predetermined value Ss is preferably set so that: when Sr is higher than or equal to Ss, it is possible to reliably prevent heat damage of the selected switching elements and to suitably adjust the relative phase of the camshaft 2 to the crankshaft with the torque reduced by partially turning off the selected switching elements. For example, the predetermined value Ss may be set to 1000 rpm.

Third Embodiment

This embodiment is a modification of the second embodiment; therefore, only the difference from the second embodiment will be described hereinafter.

In the present embodiment, when the target and actual rotational directions Dt and Dr of the motor shaft 14 are respectively coincident with the normal and reverse directions and the actual rotational speed Sr of the motor shaft 14 is lower than the predetermined value Ss, the drive portion 78 shifts the drive signal patterns in Column (a) of FIG. 14 in the backward direction. In comparison, when the target and actual rotational directions Dt and Dr are respectively coincident with the normal and reverse directions and the actual rotational speed Sr is higher than or equal to the predetermined value Ss, the drive portion 78 shifts the drive signal patterns in Column (b) of FIG. 14 in the backward direction. Here, the drive signal patterns in Column (b) of FIG. 14 are advanced, when shifted in the backward direction, by 15° more than those in Column (a) of FIG. 14.

Moreover, when the target and actual rotational directions Dt and Dr are respectively coincident with the reverse and normal directions and the actual rotational speed Sr is lower than the predetermined value Ss, the drive portion 78 shifts the drive signal patterns in Column (a) of FIG. 15 in the forward direction. In comparison, when the target and actual rotational directions Dt and Dr are respectively coincident with the reverse and normal directions and the actual rotational speed Sr is higher than or equal to the predetermined value Ss, the drive portion 78 shifts the drive signal patterns in Column (b) of FIG. 15 in the forward direction. Here, the drive signal patterns in Column (b) of FIG. 15 are advanced, when shifted in the forward direction, by 15 more than those in Column (a) of FIG. 15.

Figure 17:
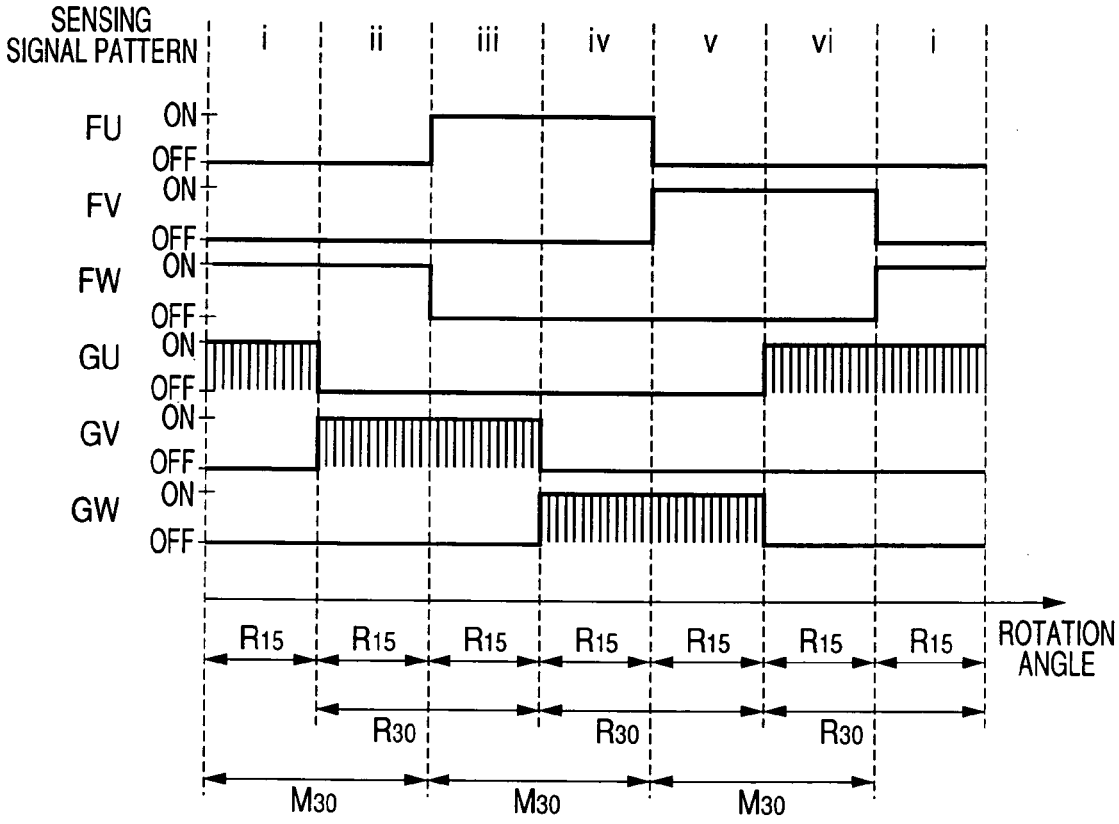

With the above operation, referring to FIGS. 16 and 17, when the actual rotational speed Sr is higher than or equal to the predetermined value Ss and the target and actual rotational directions Dt and Dr are opposite to each other, each of the selected switching elements is continuously turned on for the whole of a shifted rotation angle range $M_{30}$; the shifted rotation angle range $M_{30}$ is obtained by shifting the corresponding rotation angle range $R_{30}$ by 15° in the advancing direction. Further, the rotation angle ranges, for which the PWM switching elements are pulse-width-modulated, are also shifted. Consequently, for each of the shifted rotation angle ranges $M_{30}$, the two PWM switching elements, which belong to different ones of the arms AU, AV, and AW from the selected switching element, are respectively pulse-width-modulated for different halves of the shifted rotation angle range $M_{30}$.

With the above operation, the induced voltage, which is generated in the stator windings 16*b* in the same direction as the voltage applied to the stator windings 16*b*, is reduced. Accordingly, current flowing through the selected switching elements, which corresponds to the sum of the applied and induced voltages, is also reduced. Consequently, it is possible to prevent heat damage of the selected switching elements even when the relative phase of the camshaft 2 to the crankshaft is kept at the most-retarded value with the stopper 58*a* abutting the corresponding movable member 56.

Figure 18:
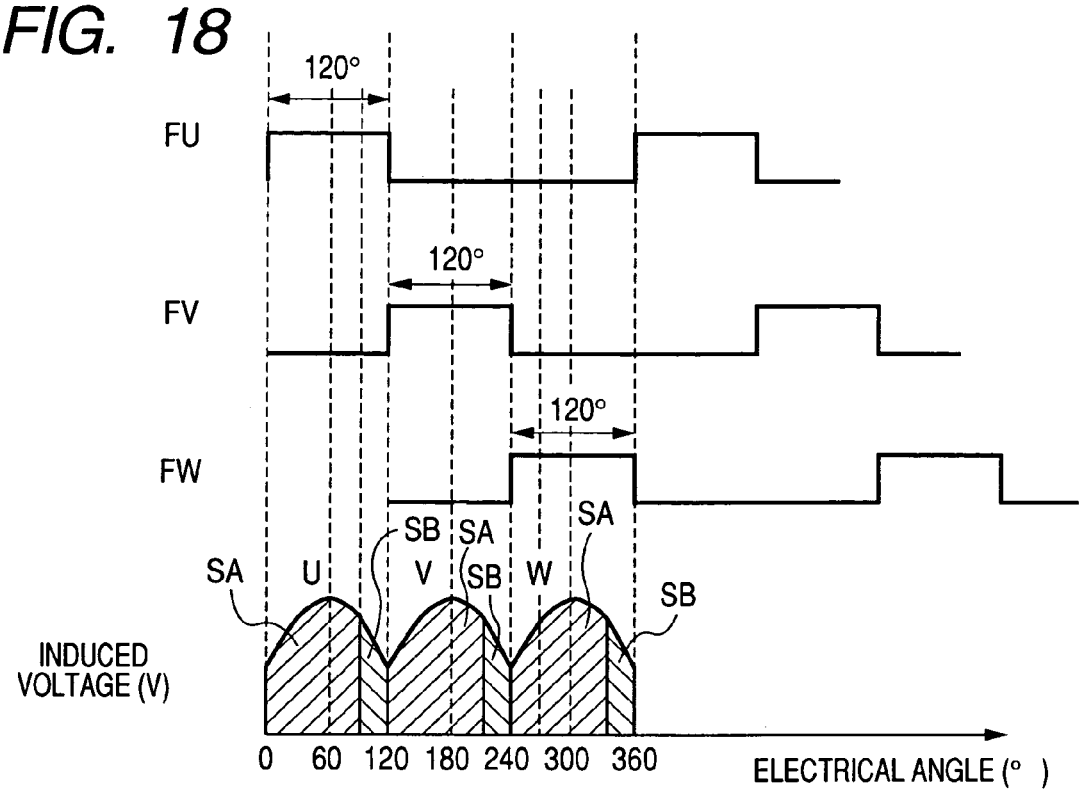
Figure 19:
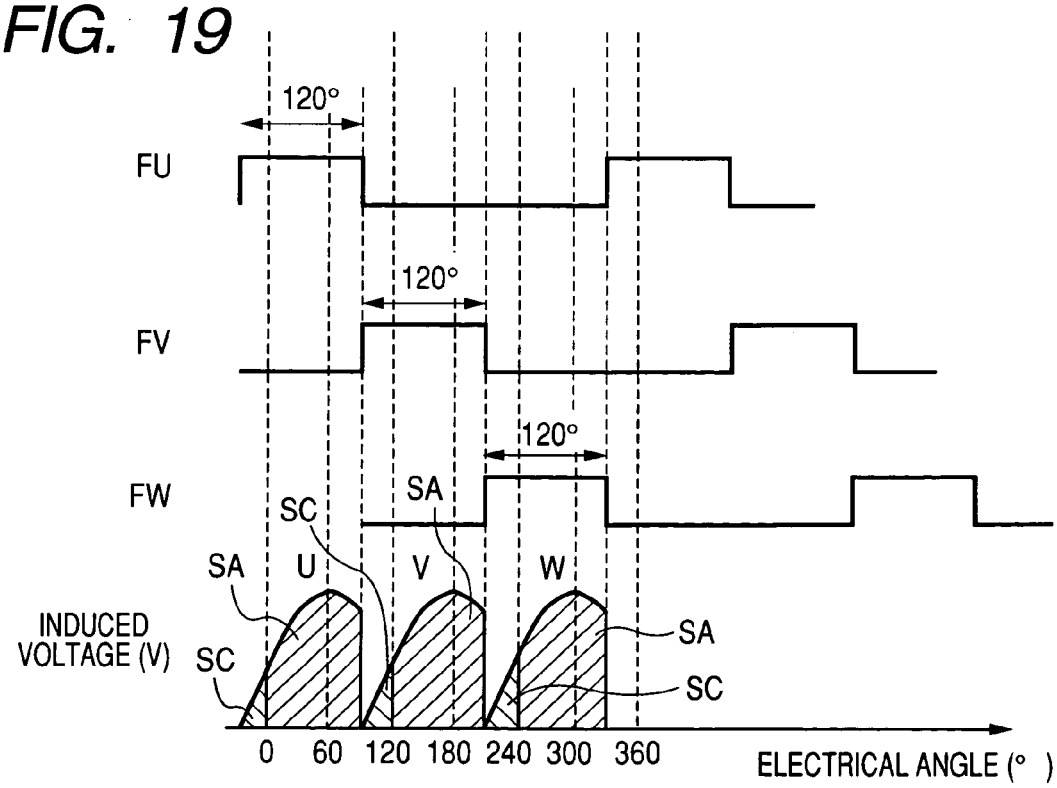

FIGS. 18 and 19 are schematic views illustrating the effect of the above operation according to the present embodiment on reduction of the induced voltage. More specifically, FIG. 18 shows the induced voltage generated in each of three different-phase stator windings 16*b* before shifting the rotation angle ranges. FIG. 19 shows the induced voltage generated in each of the three different-phase stator windings 16*b* after shifting the rotation angle ranges in the advancing direction. It should be noted that in FIGS. 18 and 19, the horizontal axis indicates electrical angle, not the rotation angle of the motor shaft 14. As seen from those figures, the areas SA in FIG. 18 are coincident with the areas SA in FIG. 19. However, the areas SC in FIG. 19 are smaller than the areas SB in FIG. 18. Accordingly, the induced voltage in FIG. 19 is lower than that n FIG. 18.

While the above particular embodiments of the invention have been shown and described, it will be understood by those skilled in the art that various modifications, changes, and improvements may be made without departing from the spirit of the invention.

Modification 1

In the previous embodiments, the selected switching elements are selected from the high-side switching elements FU, FV, and FW, and the low-side switching elements GU, GV, and GW are pulse-width-modulated.

Alternatively, the selected switching elements may be selected from the low-side switching elements CU, GV, and GW, and the high-side switching elements FU, FV, and FW may be pulse-width-modulated.

Modification 2

In the first embodiment, when the target and actual rotational directions Dt and Dr of the motor shaft 14 are opposite to each other, for each of the rotation angle ranges $R_{30}$, the ratio between the portion for which the selected switching element is continuously turned on and the remaining portion for which the selected switching element is continuously turned off is set to (1:1).

However, the ratio may also be set to other values, for example (2:1).

Modification 3

In the third embodiment, each of the selected switching elements is continuously turned on for the whole of the shifted rotation angle range $M_{30}$ only when the actual rotational speed Sr is higher than or equal to the predetermined value Ss and the target and actual rotational directions Dt and Dr are opposite to each other.

However, when the target and actual rotational directions Dt and Dr are opposite to each other, each of the selected switching elements may also be continuously turned on for the whole of the shifted rotation angle range $M_{30}$ regardless of the actual rotational speed Sr.

Further, in the third embodiment, the shifted rotation angle range $M_{30}$ is obtained by shifting the corresponding rotation angle range $R_{30}$ in the advancing direction.

However, the shifted rotation angle range $M_{30}$ may also be obtained by shifting the corresponding rotation angle range $R_{30}$ in the retarding direction.

Furthermore, in the third embodiment, the shifted rotation angle range $M_{30}$ is shifted from the corresponding rotation angle range $R_{30}$ by half of the corresponding rotation angle range $R_{30}$.

However, the shifted rotation angle range $M_{30}$ may also be shifted from the corresponding rotation angle range $R_{30}$ by different amounts, for example 30% of the corresponding rotation angle range $R_{30}$.

Modification 4

The electric motor 4 may also be implemented by other motors than the brushless, permanent magnet and synchronous motor. Moreover, the stator windings 16*b* of the electric motor 4 may also be delta-connected Modification 5

In the first embodiment, the power supply control device 6 includes the control circuit 60 and the motor drive circuit 70. Further, the motor drive circuit 70 is implemented by dedicated electric circuit elements. Furthermore, each of the switching elements is implemented by a FET.

However, the power supply control device 6 may also be configured with a single electric circuit that has both functions of the circuits 60 and 70. Further, part of the motor drive circuit 70, for example the drive portion 78, may also be implemented by a microcomputer instead of an IC. Furthermore, each of the switching elements may also be implemented by other electric devices, for example a bipolar transistor.

Modification 6

The phase adjusting mechanism 8 may also have other configurations than that described in the first embodiment.

For example, the phase adjusting mechanism 8 may have a configuration where two sun gears are respectively provided for the rotating members 22 and 24, and each mesh with a planetary gear supported by the planetary gear carrier 32.

Modification 7

In the previous embodiments, the valve timing adjusting apparatus 1 is configured to adjust the valve timing of the intake valves of the engine.

However, the valve timing adjusting apparatus 1 may also be configured to adjust the valve timing of exhaust valves or the valve timing of both the intake valves and the exhaust valves.

What is claimed is:

1. A valve timing adjusting apparatus for an internal combustion engine, which adjusts valve timing of at least one of intake and exhaust valves of the engine that are opened and closed by a camshaft driven by torque transmitted from a crankshaft of the engine, the valve timing adjusting apparatus comprising:

an electric motor including a plurality of stator windings, which create a magnetic field upon being energized, and a motor shaft that is caused by the magnetic field to rotate in one of a normal direction and a reverse direction, the motor shaft having a plurality of predetermined rotation angle ranges;

a plurality of switching elements each of which is electrically connected to a corresponding one of the stator windings;

a motor driver that drives the electric motor by selecting, for each of the rotation angle ranges of the motor shaft, one of the switching elements and turning on the selected switching element in the rotation angle range; and a phase adjusting mechanism that adjusts a relative phase of the camshaft to the crankshaft according to a rotational condition of the motor shaft;

wherein when a target rotational direction of the motor shaft is coincident with the actual rotational direction of the motor shaft, the motor driver continuously turns on the selected switching element for the whole of the rotation angle range, and when the target rotational direction of the motor shaft is opposite to the actual rotational direction of the motor shaft, the motor driver continuously turns on the selected switching element only for part of the rotation angle range, and continuously turns off the selected switching element for the remaining part of the rotation angle range.

2. The valve timing adjusting apparatus as set forth in claim 1, wherein the phase adjusting mechanism includes:

an input rotating member, which inputs torque from the motor shaft, is rotatable along with the crankshaft in the normal direction, and is also rotatable along with the motor shaft in both the normal and reverse directions; and a stopper that stops the rotation of the input rotating member along with the motor shaft, thereby keeping the relative phase of the camshaft to the crankshaft at a limit value.

3. The valve timing adjusting apparatus as set forth in claim 1, wherein when the motor shaft rotates at a speed lower than a predetermined value, the motor driver continuously turns on the selected switching element for the whole of the rotation angle range regardless of whether the target rotational direction of the motor shaft is coincident with or opposite to the actual rotational direction of the motor shaft.

4. The valve timing adjusting apparatus as set forth in claim 1, wherein the part, for which the motor driver continuously turns on the selected switching element, accounts for half of the rotation angle range.

5. The valve timing adjusting apparatus as set forth in claim 1, wherein the switching elements together make up a plurality of arms, each of the arms includes two of the switching elements, which are serially connected with respect to a power source, thereby respectively functioning as a high-side and a low-side switching element, the midpoint between the high-side and low-side switching elements in each of the arms is electrically connected to a corresponding one of the stator windings, and the motor driver is configured to:

select one of the high-side and low-side switching elements in one of the arms as the selected switching element, select one of the high-side and low-side switching elements in another one of the arms, which is on a different side from the selected switching element, as a PWM switching element, and turn on and off the PWM switching element through a PWM (Pulse-Width Modulation) control.

6. The valve timing adjusting apparatus as set forth in claim 1, further comprising a controller that controls the motor driver, the controller being configured to:

determine the actual value of the valve timing based on the rotational condition of the motor shaft, set a target value of the valve timing based on the operating condition of the engine, set the target rotational direction of the motor shaft based on the difference between the target and actual values of the valve timing, and output a control signal, which indicates the set target rotational direction, to the motor driver.

7. The valve timing adjusting apparatus as set forth in claim 1, wherein the rotational condition of the motor shaft is represented by both the rotational direction and rotational speed of the motor shaft.

8. A valve timing adjusting apparatus for an internal combustion engine, which adjusts valve timing of at least one of intake and exhaust valves of the engine that are opened and closed by a camshaft driven by torque transmitted from a crankshaft of the engine, the valve timing adjusting apparatus comprising:

an electric motor including a plurality of stator windings, which create a magnetic field upon being energized, and a motor shaft that is caused by the magnetic field to rotate in one of a normal direction and a reverse direction, the motor shaft having a plurality of predetermined rotation angle ranges;

a plurality of switching elements each of which is electrically connected to a corresponding one of the stator windings;

a motor driver that drives the electric motor by selecting, for each of the rotation angle ranges of the motor shaft, one of the switching elements and turning on the selected switching element in the rotation angle range; and a phase adjusting mechanism that adjusts a relative phase of the camshaft to the crankshaft according to a rotational condition of the motor shaft;

wherein when a target rotational direction of the motor shaft is coincident with the actual rotational direction of the motor shaft, the motor driver continuously turns on the selected switching element for the whole of the rotation angle range, and when the target rotational direction of the motor shaft is opposite to the actual rotational direction of the motor shaft, the motor driver continuously turns on the selected switching element for the whole of a shifted rotation angle range that is obtained by shifting the rotation angle range in one of advancing and retarding directions.

9. The valve timing adjusting apparatus as set forth in claim 8, wherein the phase adjusting mechanism includes:

an input rotating member, which inputs torque from the motor shaft, is rotatable along with the crankshaft in the normal direction, and is also rotatable along with the motor shaft in both the normal and reverse directions; and a stopper that stops the rotation of the input rotating member along with the motor shaft, thereby keeping the relative phase of the camshaft to the crankshaft at a limit value.

10. The valve timing adjusting apparatus as set forth in claim 8, wherein when the motor shaft rotates at a speed lower than a predetermined value, the motor driver continuously turns on the selected switching element for the whole of the rotation angle range regardless of whether the target rotational direction of the motor shaft is coincident with or opposite to the actual rotational direction of the motor shaft.

11. The valve timing adjusting apparatus as set forth in claim 8, wherein the shifted rotation angle range is obtained by shifting the rotation angle range in one of the advancing and retarding directions by half of the rotation angle range.

12. The valve timing adjusting apparatus as set forth in claim 8, wherein the switching elements together make up a plurality of arms, each of the arms includes two of the switching elements, which are serially connected with respect to a power source, thereby respectively functioning as a high-side and a low-side switching element, the midpoint between the high-side and low-side switching elements in each of the arms is electrically connected to a corresponding one of the stator windings, and the motor driver is configured to:

select one of the high-side and low-side switching elements in one of the arms as the selected switching element, select one of the high-side and low-side switching elements in another one of the arms, which is on a different side from the selected switching element, as a PWM switching element, and turn on and off the PWM switching element through a PWM (Pulse-Width Modulation) control.

13. The valve timing adjusting apparatus as set forth in claim 8, further comprising a controller that controls the motor driver, the controller being configured to:

determine the actual value of the valve timing based on the rotational condition of the motor shaft, set a target value of the valve timing based on the operating condition of the engine, set the target rotational direction of the motor shaft based on the difference between the target and actual values of the valve timing, and output a control signal, which indicates the set target rotational direction, to the motor driver.

14. The valve timing adjusting apparatus as set forth in claim 8, wherein the rotational condition of the motor shaft is represented by both the rotational direction and rotational speed of the motor shaft.

* * * * *